US006270069B1

(12) United States Patent
Cera et al.

(10) Patent No.: US 6,270,069 B1
(45) Date of Patent: Aug. 7, 2001

(54) DOUBLES RESOLVER MECHANISM AND METHOD FOR THE USE THEREOF

(76) Inventors: George Cera, 449 Glendale Dr., #64, Endicott, NY (US) 13760; Wayne Blackwell, 169 Conklin Hill Rd., Chenango Forks, NY (US) 13746; Lou Taylor, 579 Barton Rd., Apalachin, NY (US) 13732

( * ) Notice: Subject to any disclaimer, the term of this patent is extended or adjusted under 35 U.S.C. 154(b) by 0 days.

(21) Appl. No.: 09/490,248

(22) Filed: Jan. 24, 2000

(51) Int. Cl.[7] ..... B65H 3/34

(52) U.S. Cl. ..... 271/104; 271/121; 271/124; 271/167

(58) Field of Search ..... 271/104, 121, 271/124, 137, 167

(56) References Cited

U.S. PATENT DOCUMENTS 3,126,201 * 3/1964 Rehm ..... 271/104

4,357,007 * 11/1982 Mens Franciscus et al. ..... 271/96

* cited by examiner

*Primary Examiner*—David H. Bollinger

(57) ABSTRACT

A method and apparatus for resolving doubles on singulated flat articles being passed in a downstream direction to a takeaway mechanism by use of a doubles resolver mechanism ahead of the takeaway mechanism. The doubles resolver mechanism includes a doubles resolver head through which negative pressure may be applied to articles passing thereunder, and a mount for the head which positions the head against such articles with a substantially constant force regardless of the thickness of the article. Negative pressure is applied to the head except when the head is detected as having resolved a double, at which time such pressure is momentarily removed to permit the double to be cleared.

20 Claims, 6 Drawing Sheets

VACUUM ON

VACUUM OFF

DOUBLES RESOLVER MECHANISM AND METHOD FOR THE USE THEREOF

FIELD OF THE INVENTION

This invention relates to methods and apparatus for handling flat articles, such as mixed mail, and more particularly to a mechanism for resolving doubles at the output from a singulation mechanism of such a system and to a method for the use of such mechanism.

BACKGROUND OF THE INVENTION

In systems for handling mixed mail or other flat articles, which may or may not be of a uniform size, the articles are frequently stacked on edge and passed through a singulation mechanism at the beginning of the operation. However, particularly where there are significant variations in the size, thickness and weight for the articles being singulated, the singulator will it from time to time pass two or more pieces of mail or other articles simultaneously, a smaller article for example piggy-backing on a larger article being singulated. This problem, which is commonly referred to as doubles or multiple feeds, if left unresolved, can possibly lead to missorts, damage to the articles, rejects or jams in downstream parts of the system. While many techniques have been employed in the past to resolve such doubles, particularly in mail handling systems, the variations in size, weight and thickness of mixed mail make doubles very difficult to resolve. For example, one specification for a mixed mail handling system requires handling mail vary in size from 4"×4" or 3.5"×5.0" to 15"×15", weights from a 0.03 ounces to six pounds and thickness from 0.007" up to 1.25 inches. Further, some of the larger pieces may be soft covered magazines, catalogs, telephone books or the like which are bound on only one edge, further complicating the singulation and doubles resolving process. Mechanisms for successfully resolving doubles at the output of a singulator in a system handling articles of mixed size, thickness and weight with variations on the order of those indicated above do not currently exist.

SUMMARY OF THE INVENTION

In accordance with the above, this invention provides a method and apparatus for resolving doubles exiting a singulation mechanism which takes advantage of the fact that the doubled piece will typically be a thinner, lighter piece. The invention thus provides, in a system for passing a singulated flat article in a downstream direction from a singulation mechanism to a takeaway mechanism, a doubles resolver mechanism which includes a doubles resolver head having negative pressure selectively applied to an operative surface thereof, and a mount for the head which mount positions the operative surface of the head against a side of each article which is opposite the side against which drive is applied by the singulation and takeaway mechanisms, the mount pressing the head against each article, as the article passes between the singulation mechanism and the takeaway mechanism, with a force which is substantially constant regardless of the thickness of the article. The mount preferably includes a gas spring operating on the head to apply the constant force thereto. For preferred embodiments, the gas spring is a pneumatic cylinder, a controlled positive pneumatic pressure source applying gas pressure to the cylinder to control the constant force being applied thereby. The mount may also include a stop which limits movement of the head against the force being applied by the gas spring. The head may also be attached to at least one shaft mounted in a bearing, the shaft moving in the bearing to facilitate movement of the head parallel to the direction of the force applied to the article. For at least one embodiment of the invention, the operative surface of the head is at a slight angle to the downstream direction. For another embodiment, the head is mounted to rotate from a position with its operative surface substantially parallel to the direction of article movement, or at a slight angle thereto, to a position at a greater angle to such direction as each article passes under the head. For this embodiment, a passive valve may be provided which reduces the negative pressure applied to the operative surface of the head as the angle for the operative surface increases, the valve substantially cutting off the negative pressure when the operative surface is an at a selected maximum angle for an illustrative embodiment. The head separates and holds a doubled article piggybacking on an article passing from the singulation to the takeaway mechanism, negative pressure normally being applied to the operative surface, but being cut off when a doubled article is detected as being held by the head. For preferred embodiments, the articles on which the doubles resolver mechanism is used are mixed mail.

The invention also includes a method for resolving doubles in a system of the type previously indicated, which method includes mounting a doubles resolver head having negative pressure applied to an operative surface thereof between the singulation mechanism and the takeaway mechanism, with the side of each article opposite that to which drive is applied by the singulation and takeaway mechanisms in contact with the operative surface of the head as each article passes thereunder; and pressing the head against each article with a force which is substantially constant regardless of the thickness of the article. The mounting step may mount the head with the operative surface angled slightly away from the direction of article movement or the head may be mounted to rotate from a position with its operative surface substantially parallel to the direction of article movement to a position at a slight angle to such direction as each article passes under the head. In the latter case, the negative pressure applied to the operative surface of the head may be reduced as the angle for such operative surface increases, and may be substantially cut off when the operative surface is at a selected maximum angle to the direction of article movement. The head preferably separates and holds a doubled article, negative pressure normally being applied to the operative surface and being cutoff when a doubled article is detected as being held by the head. When the negative pressure is cut off, the doubled article is preferably adjacent to the drive for at least one of the singulation or the takeaway mechanism and such drive is then operated to clear the doubled article. Finally, the invention includes a doubles resolver head having negative pressure normally applied to an operative surface of the head, and a mount for the head which mount positions an operative surface of the head against the non-driven side of each article as the article passes between the singulation and takeaway mechanisms, the head separating and holding a doubled article, and the negative pressure being cut off when a doubled article is detected as being held by the head.

The foregoing and other objects, features and advantages of the invention will be apparently from the following more particular description of preferred embodiments of the invention as illustrated in the accompanying drawings, the same reference numerals being used for common elements in the various drawings.

IN THE DRAWINGS

DETAILED DESCRIPTION

Figure 1:
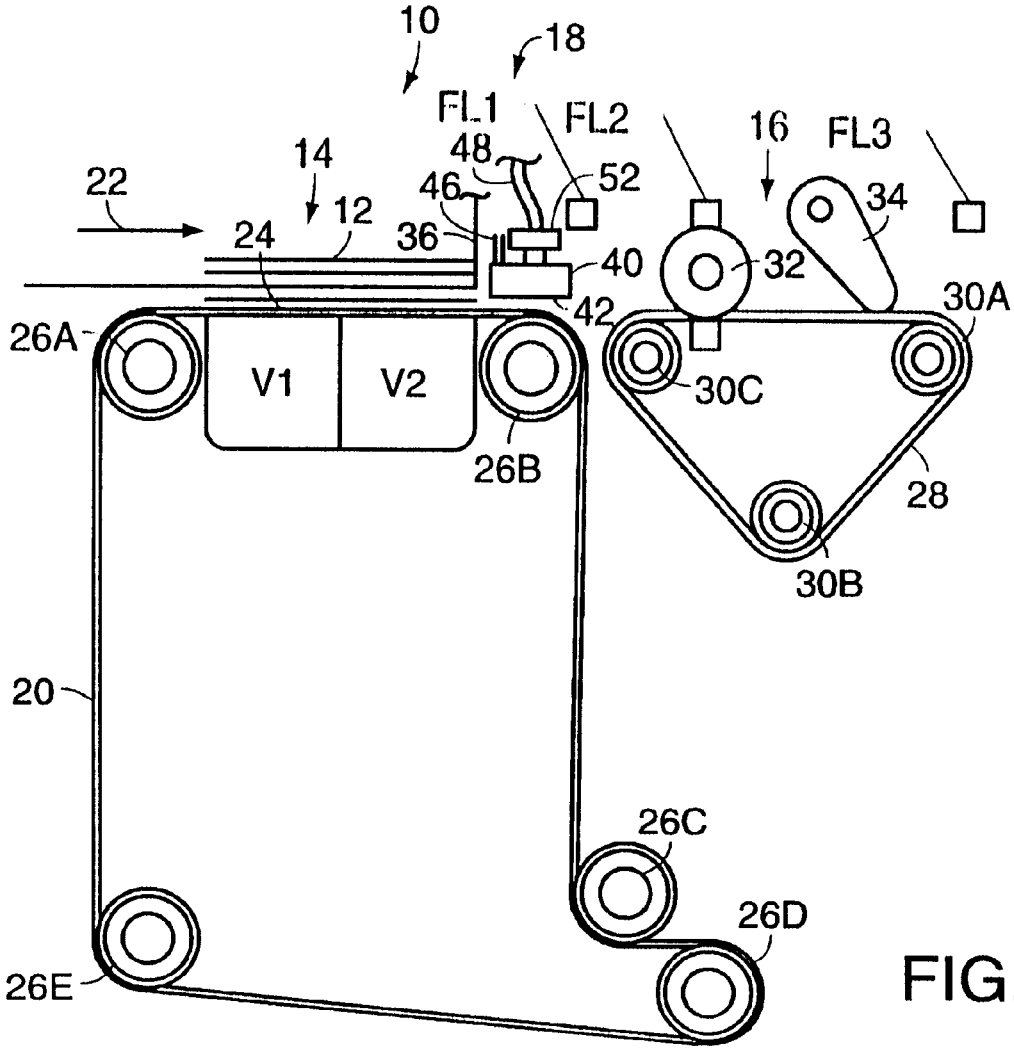
FIG. 1 is a semi-diagrammatic view illustrating a mixed mail handling system in which the teachings of this invention may be utilized.

FIG. 1 illustrates a system 10 for processing a stack of articles 12 which, for the illustrative embodiment will be assumed to be mixed mail. The system includes a singulation mechanism 14, a take away mechanism 16, and a doubles resolver head 18 of this invention positioned between the singulation and take away mechanisms. The system shown in FIG. 1 is described in some detail in co-pending applications Ser. Nos. 09/411,961 and 09/410,940, both of which were filed on Oct. 4, 1999, and both of which are assigned to the Assignee of this application. While the system is generally described in both of the co-pending applications, singulation mechanism 14 is particularly described in the Ser. No. 09/411,961 application and take away mechanism 16 is particularly described in the Ser. No. 09/410,940 application. The descriptions of these mechanisms contained in the co-pending applications are incorporated herein by reference, and these mechanisms will therefore only be discussed briefly in this application, it being understood that the specific singulation mechanism 14 and take away mechanism 16 are being provided for purposes of illustration only, and that any mechanisms capable of performing the disclosed singulation and take away functions could be used in their place.

In particular, singulation mechanism 14 includes a drive belt 20 which moves in direction 22 across face 24 of a singulation head. Belt 20 passes over a series of rollers 26A–26E, one of which, for example roller 26D, is driven to move the belt. The surface of the belt against which articles 12 are pressed is preferably of a substantially friction free material so that articles 12 pressed against the belt are normally not moved in the direction 22 thereby unless vacuum is applied to the article through openings formed in the belt, vacuum being applied to either vacuum chamber V1 or V2. As discussed in greater detail in the beforementioned co-pending applications, vacuum is applied first to vacuum chamber V1 to cause an initial movement of the article in contact with the belt at high acceleration. This vacuum is then released and vacuum applied to vacuum chamber V2 to cause a second acceleration of the article in direction 22, this action being intended to shake or shear off any double attempting to piggy back on the article being fed.

An article (or where there is a double, articles) leaving singulation mechanism 14 pass under the doubles resolver mechanism of this invention, which will be described shortly, to take away mechanism 16. Take away mechanism 16 includes a belt 28 passing over three rollers 30A–30C, one of which, for example roller 30A, is driven. Belt 28 preferably has a tacky outer surface, and for preferred embodiments is at least two spaced adjacent belts. A pair of rollers 32 and a pair of fingers 34 operate to hold an article in good contact with belt 28 to effect take away of the article. For the illustrative embodiment, belt 28 moves at a higher speed than belt 20 for reasons discussed in the co-pending applications, including clearing doubles and preventing jams. Detectors or sensors F1, F2, and F3 are provided at various points in the travel path of the article, these sensors operating in conjunction with a processor (not shown) to control the operation of the system.

While the shearing action of vacuum chambers V1 and V2 minimizes doubles exiting singulation mechanism 14, and wall 36 on the leading side of singulation mechanism 14, which is spaced from belt 20 by a distance just larger than the thickness of the thickest article to be singulated, removes any relatively thick double which might try to pass, it is possible that the system shown in FIG. 1 will still pass, and the system in fact does sometimes pass, relatively thin doubles to the take away mechanism. The doubles resolver mechanism of this invention is intended to prevent any such double from reaching the take away mechanism.

Figure 2A:
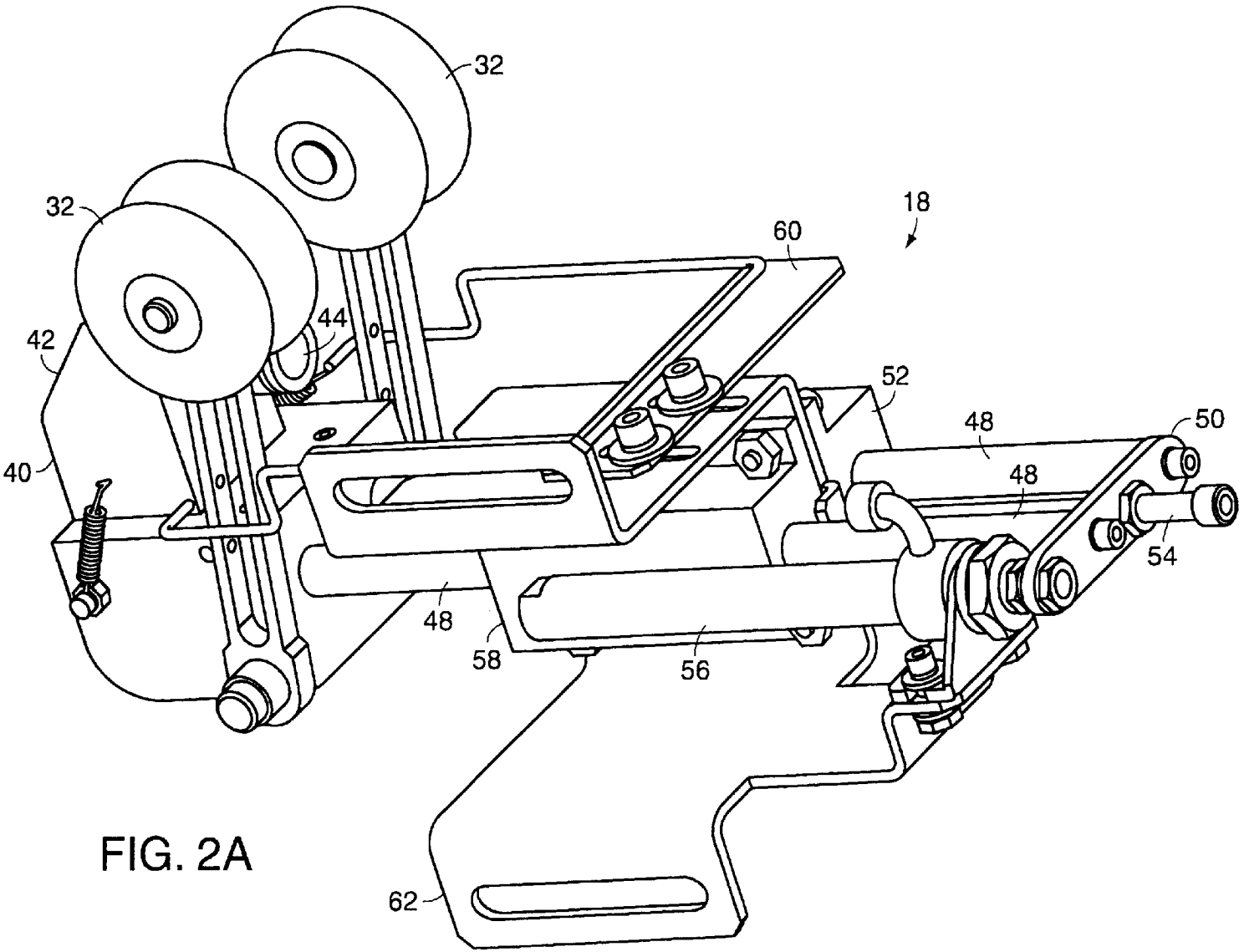
FIGS. 2A and 2B are a rear bottom, left-side perspective view and a rear, bottom, right-side perspective view, respectively of a doubles resolver mechanism in accordance with one embodiment of the invention.
Figure 2B:
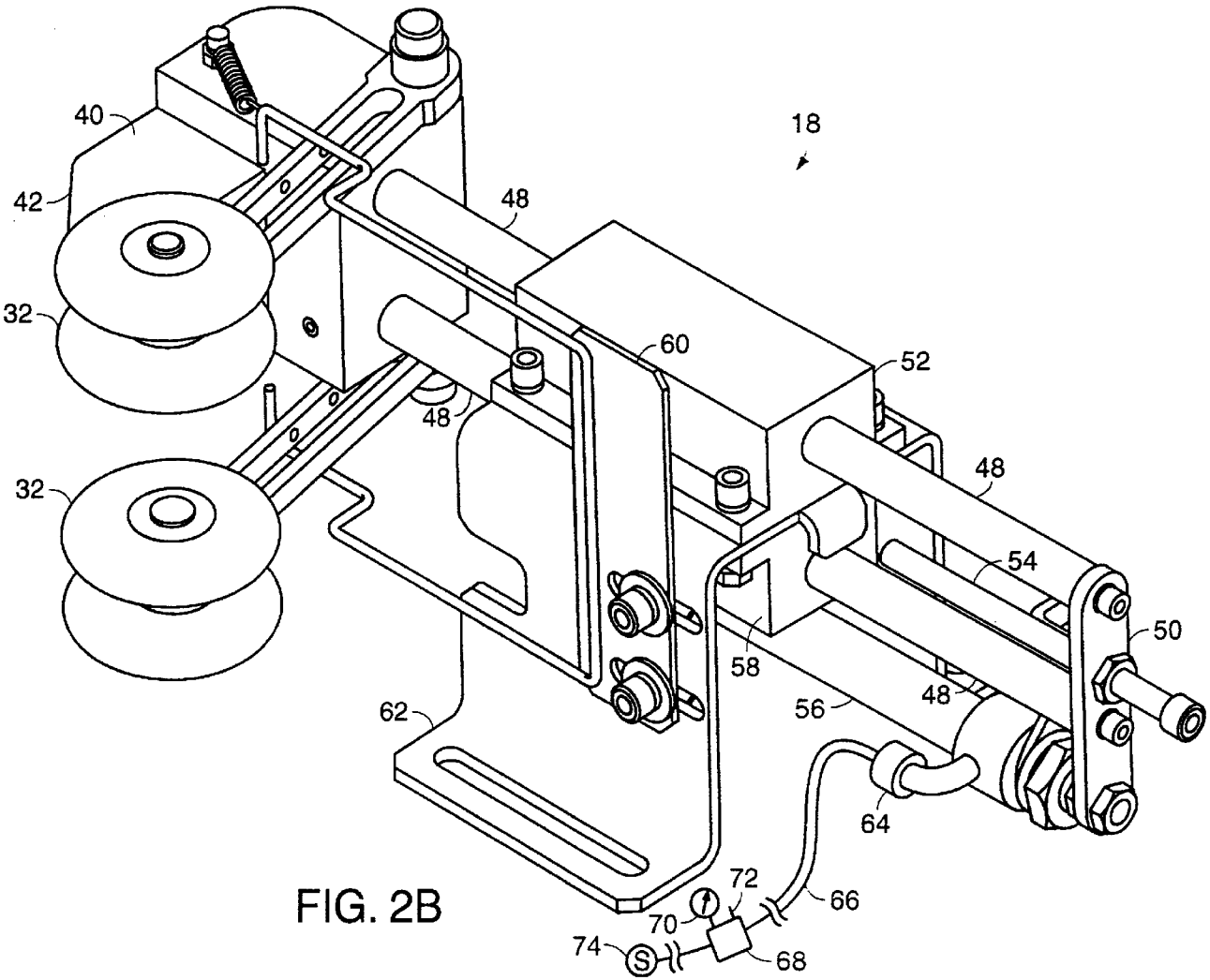

FIGS. 2A and 2B illustrate a doubles resolver mechanism 18 for a first illustrative embodiment of the invention. This mechanism consists of a doubles resolver head 40 having an operative surface 42 with openings formed therein through which vacuum may be applied to articles 12 coming in contact with, or otherwise passing under the head, and a port 44 through which vacuum pressure may be applied to the head from a vacuum or other negative pressure source through a suitable hose 46 (see FIG. 1). For an illustrative mixed mail application, a vacuum of approximately 8" to 10" of mercury is pulled through the holes in surface 42. Vacuum line 46 may be connected to a valve (not shown) that can be operated, preferably under processor control, to turn the vacuum on and off, as required.

Head 40 is connected by a pair of metal shafts 48 to a back plate 50, shafts 48 passing through a linear pillow, bearing containing block 52 positioned between head 40 and plate 50. A stop bolt 54 is also connected to back plate 50 and may bear against a block bracket 58 to limit the forward motion of head 40 so that it may get close enough to belt 20 to contact the thinnest article/mail passing through the system, while not actually contacting the belt. Backplate 50 both supports shafts 48 at their rear end and maintains their spacing equal to that at the linear bearings 52 to assure free movement of the shafts in the bearings. Plate 54 also has the end of a piston rod of pneumatic or air cylinder 56 attached thereto, the body of the cylinder 56 being mounted to bracket 58, which bracket also supports pillow box or bearings 52. Bracket 58 is secured by suitable brackets 60 and 62 to the housing of system 10. Referring to FIG. 2B, pneumatic cylinder 56 has an air input port 64 connected through a suitable hose 66 to an air pressure regulator 68 having a gauge 70 and a control input 72. Regulator 68 is connected to a source of positive air pressure 74. Control 72 may either be manually adjusted or may be adjusted in response to control inputs from a processor to determine the air pressure applied to cylinder 56, and thus the pressure or force at which operative surface 42 of head 40 is pressed against articles 12 passing thereunder. Air cylinder 56 acts as a constant force "air spring" to head 40, the force being adjusted by controlling input 72 to regulator 68.

As indicated earlier, doubles resolver head 18 is positioned in what may be considered an "idle zone" between the drives for singulation mechanism 14 and take away mechanism 16. This permits resolver mechanism 18 to resolve any double exiting singulation mechanism 12 before such double reaches the take away mechanism.

Figure 4A:
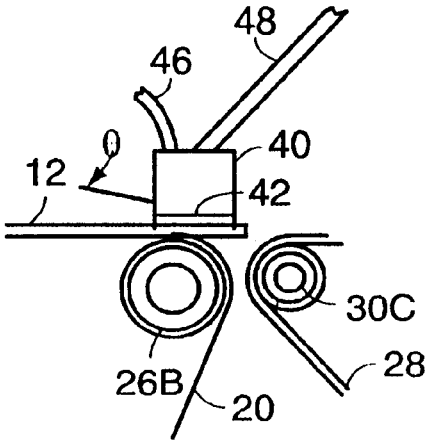
FIGS. 4A and 4B are diagrammatic side views illustrating articles of different thickness passing under the doubles resolver head for the embodiment of FIGS. 2A and 2B.
Figure 4B:
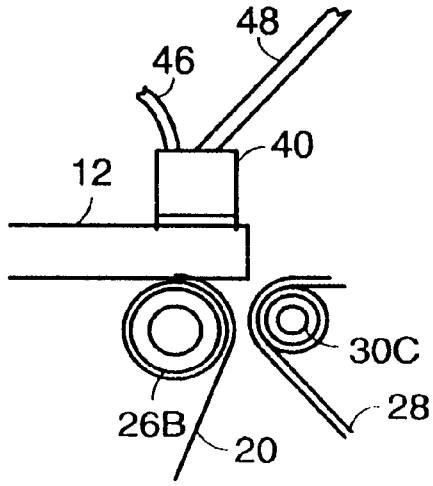

As shown in FIG. 4A, operative surface 42 of resolver head 40 is at a slight angle θ to the direction 22 in which articles 12 move thereunder. The angle θ may for example be approximately 1.5°. This slight angle permits the leading edge of each article to act on operative face 42 to raise head 40 against the air spring action of pneumatic cylinder 56 so as to permit the article to pass under head 40 while maintaining surface 42 of the head in contact with the article with a substantially constant force. FIGS. 4A and 4B illustrate how head 40 moves to permit articles 12 of varying thickness to pass thereunder. When each article passes head 40, the constant pressure of cylinder 56 returns head 40 to its fully extended position as determined by stop 54. The stroke length of cylinder 54 is selected to allow articles/mail pieces within the full range of thicknesses for which the system is designed to pass under head 40. Because of the constant force of air spring cylinder 56, head 40 does not get bounced out of the way by incoming articles/mail 12, but maintains a substantially constant pressure/force on the articles. The constant force is particularly advantageous when passing thicker articles, as for example shown in FIG. 4B, in that it applies the same amount of force to the article no matter how far the head is deflected. This differs from a standard extension spring which applies a greater amount of force as it is extended. A greater force applied to thicker articles could cause stalling of the article under the doubles resolver head, resulting in jams and possible damage to the articles being fed.

Figure 5:
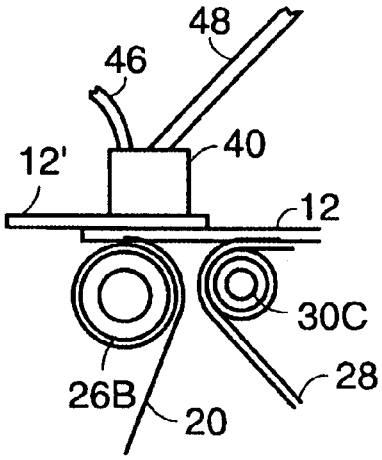
FIG. 5 is a diagrammatic side view illustrating the resolving of a double for the embodiment of the invention shown in FIGS. 2A and 2B.

In operation, because of the relatively low vacuum pressure on head 40, and because of the angle of surface 42, single pieces of mail or other flat articles are able to pass under head 40. Further, because of their momentum leaving singulation mechanism 14, and because the spacing between wall 36 and roller 32 is less than the length of the shortest article being singulated, articles being singulated thus being driven during their entire passage past doubles resolver mechanism 18, articles normally pass the doubles resolver without getting significantly slowed down or stopped. However, as may be seen in FIG. 5, when a double is passed under head 40, the outside piece 12' is not touching either of the drive belts 20, 28, and is therefore contacted only by the vacuum double resolvers head 40, which is therefore effective to grab and hold such doubled article. Because wall 36 will prevent a relatively large double from being passed, it can be assumed that any double to be resolved by mechanism 18 is significantly less than maximum in both thickness and weight so that the relatively low vacuum applied to surface 42 of head 40 is more than adequate for holding such doubles. The assumption of relatively thinner and lighter doubled articles is further supported by the fact that the inertia of a heavy article would prevent it from being doubled. Conversely, the inner article 12 does not touch resolver head 40 in a situation where there is a double, and therefore continues to be passed by a drive belt to the take away mechanism without being engaged or impeded by resolver head 40.

A photocell or other suitable sensor F1 senses when an article is in the space thereunder between the singulation and take away mechanisms and is not moving. Appropriate software in it a processor controlling the operation, by checking for example photocells F1, F2 and F3, assesses the situation and determines that there is a resolved double being held by head 40. In response to this determination, a valve (not shown) connecting vacuum line 46 to port 44 is turned off, momentarily removing vacuum from head 40. When this occurs, the doubled article 12' is forced back toward at least one of belts 20 and 28 by the action of air spring cylinder 56. At the same time, vacuum chamber V2 may be energized to provide drive to the article so that it may reach take away mechanism 16, and in particular pinch rollers 32 thereof. This permits the doubled article 12' to be cleared.

One problem in feeding articles such as mixed mail is that some of the mail articles are soft-covered catalogs, magazines and the like which are bound on only one side. To permit handling of such articles, the system is designed to have such articles fed bound-edge down. To permit resolving of doubles on such articles, head 40 is positioned approximately midway on the height of the smallest articles to be fed, for example 2" from the bottom of the article where the smallest article is 4"×4". At this height, the vacuum deals with the strongest portion of the article, the portion near the bound edge, thereby minimizing damage over the larger volume.

Figure 3A:
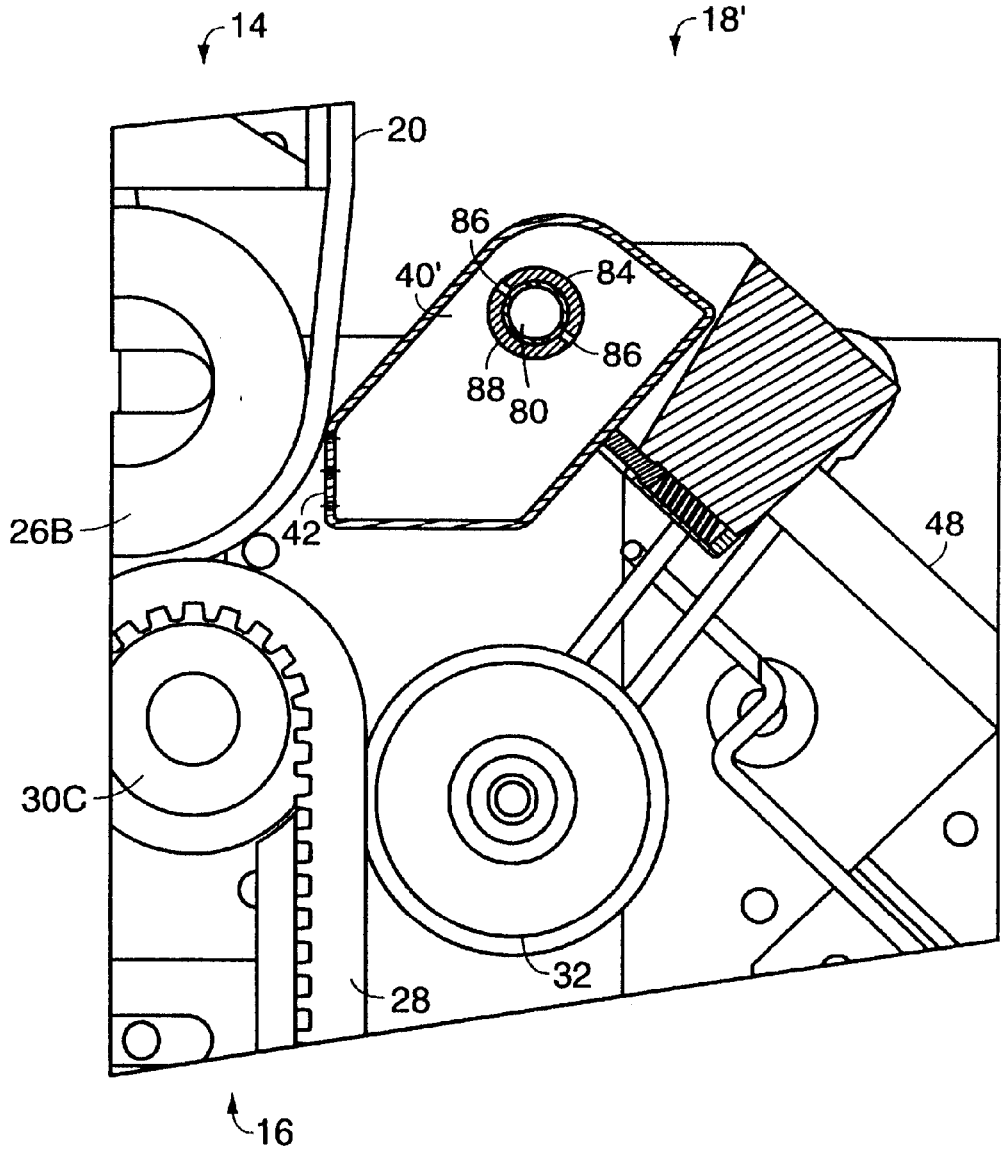
FIGS. 3A and 3B are partial side views of a doubles resolver head mechanism for a second embodiment of the invention shown in a normal position with vacuum on and a deflected position with vacuum off, respectively.
Figure 3B:
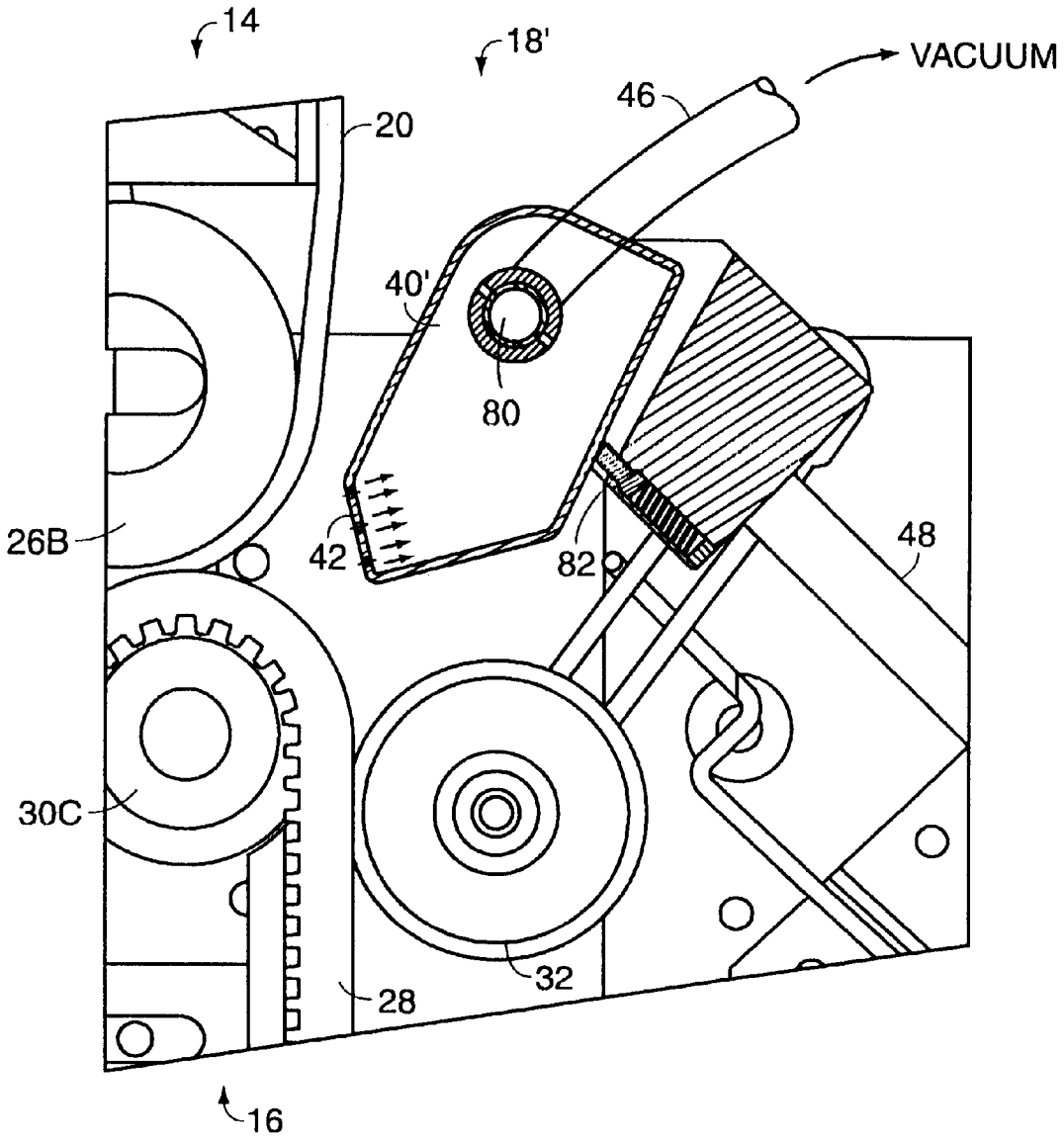

FIGS. 3A and 3B illustrate an alternative embodiment of the invention which utilizes the same shafts 48, bearing pillow block 52 and pneumatic air cylinder 56 as for the prior embodiment, but utilizes a different head mechanism 40'. In particular, instead of having a fixed angular position for operative surface 42 relative to the direction of article movement as for the embodiment of FIGS. 2A and 2B, this embodiment of the invention mounts head 40' so as to be rotatable about a hollow shaft 80. Thus, in addition to an article causing head 40 to be raised against the force applied by air cylinder 56 as shown in FIGS. 4A and 4B, the head preferable being normally at a slight angle, for example 1.5°, as for the prior embodiment, to facilitate this action, an article passing under the head also causes the head to rotate from the normal position shown in FIG. 3A to the rotated position shown in FIG. 3B against the force applied to head 40' by a spring-loaded pin 82. Hollow shaft 80 has vacuum on vacuum line 46 applied thereto. There are two slots 84 in the wall of shaft 80 which, when the head is in the position shown in FIG. 3A, align with corresponding openings 86 in a fixed ring 88 surrounding the shaft to permit vacuum to be applied through the head to the openings of operative surface 42. However, when the shaft is rotated as shown in FIG. 3B, openings 84 and 86 do not align, cutting off vacuum to the vacuum head. Shaft 80 and ring 88 thus form a passive valve for cutting off vacuum when head 40' is substantially fully rotated. The small amount of rotation described above causes a peeling action on any double engaged by the resolver head to assure separation of the doubled article from the article 12 thereunder which is being fed. The movement of head 40 against the pressure of air spring cylinder 56 deals with thicker and heavier articles, providing increased movement and greater peeling action. The passive valve discussed above automatically releases the doubled article as the article 12 being singulated passes, permitting the doubled article to be cleared either automatically as a result of the slight forward momentum which the article still has as a result of the rotating action, or by for example reenergizing vacuum chamber V2 as discussed above.

Thus, a doubles resolver mechanism has been provided which is capable of resolving doubles in mixed mail or other applications where articles of substantially different size, thickness and weight are being handled. While cylinder 56 is shown as an air cylinder for preferred embodiments, and air pressure is preferred because of its ready availability in most facilities where such a machine would be utilized, in a suitable application, a hydraulic cylinder might be utilized or some other constant pressure "spring" mechanism might be employed. Other details in design of mechanism 18 may also be varied with application. Thus, while the invention has been particularly shown and described above with reference to preferred embodiments, the foregoing and other changes in form and detail may be made therein by one skilled it the art while still remaining within the spirit and scope of the invention which is to be defined only by the appended claims.

What is claimed is:

1. In a system for passing a singulated flat article in a downstream direction from a singulation mechanism to a take-away mechanism, each of said mechanisms applying drive to a first side of each article, a doubles resolver mechanism including:

a doubles resolver head, said head including a mechanism for selectively applying negative pressure to an operative surface thereof; and a mount for said head, said mount positioning said operative surface of the head against a second side of each article, which second side is opposite said first side, as each article passes between said singulation mechanism and said take-away mechanism, said mount pressing said head against each article with a force which is substantially constant regardless of the thickness of the article.

2. A mechanism as claimed in claim 1 wherein said mount includes a gas spring operating on said head to apply said constant force thereto.

3. A mechanism as claimed in claim 2 wherein said gas spring is a pneumatic cylinder, and including a controlled positive pneumatic pressure source applying gas pressure to said cylinder, said constant force being a function of said pneumatic pressure.

4. A mechanism as claimed in claim 2 including a stop which limits movement of said head against the force applied by said gas spring.

5. A mechanism as claimed in claim 2 wherein said head is attached to at least one shaft mounted in a bearing to facilitate movement of the head parallel to the direction of said force.

6. A mechanism as claimed in claim 1 wherein said operative surface is at a slight angle to said downstream direction.

7. A mechanism as claimed in claim 1 wherein said head is mounted to rotate from a position with said operative surface substantially parallel to said direction to a position at a slight angle to said direction as each article passes under said head.

8. A mechanism as claimed in claim 7 including a passive valve which reduces said negative pressure applied to the operative surface of the head as the angle for said operative surface increases.

9. A mechanism as claimed in claim 8 wherein said valve substantially cuts off said negative pressure when said operative surface is at a selected maximum angle to said direction.

10. A mechanism as claimed in claim 1 wherein said head separates and holds a doubled article, wherein said negative pressure is normally applied to said operative surface, and wherein said negative pressure is cut off when a doubled article is detected as being held by said head.

11. A mechanism as claimed in claim 1 wherein said articles are mixed mail.

12. A method as claimed in claim 1 wherein said take-away mechanism includes a component applying pressure to said second side of each article as the article enters the take-away mechanism; and wherein said component is mounted to move with said mount, the spacing between said head and said component being such that each article reaches said component while still also under said head.

13. In a system for passing a singulated flat article in a downstream direction from a singulation mechanism to a take-away mechanism, each of said mechanisms applying drive to a first side of each article, a method for resolving doubles including:

mounting a doubles resolver head having a mechanism for applying negative pressure to an operative surface thereof between said singulation mechanism and said take-away mechanism with a second side of each article, which second side is opposite of said first side, against each article as the article passes under the head; and pressing said head against each article with a force which is substantially constant regardless of the thickness of the article.

14. A method as claimed in claim 13 wherein said mounting step includes mounting said head with said operative surface at a slight angle to said downstream direction.

15. A method as claimed in claim 13 wherein said mounting step includes mounting said head to rotate from a position with said operative surface substantially parallel to said direction to a position at a slight angle to said direction as each article passes under said head.

16. A method as claimed in claim 13 including reducing said negative pressure applied to said operative surface as the angle for said operative surface increases.

17. A method as claimed in claim 16 wherein said negative pressure is substantially cut-off when said operative surface is at a selected maximum angle to said direction.

18. A method as claimed in claim 13 wherein said head separates and holds a doubled article, wherein said negative pressure is normally applied to said operative surface, and wherein said negative pressure is cut off when a doubled article is detected as being held by said head.

19. A method as claimed in claim 18 wherein said doubled article is adjacent at least one the drive for the singulation and the take-away mechanism when said negative pressure is cut off, and including operating said at least one drive to clear the doubled article.

20. In a system for passing a singulated flat article in a downstream direction from a singulation mechanism to a take-away mechanism, each of said mechanisms applying drive to a first side of each article, a doubles resolver mechanism including:

a doubles resolver head, said head including a mechanism in which normally applies negative pressure to an operative surface thereof; and a mount for said head unit mount positioning said operative surface of the head against a second side of each article, which second side is opposite said first side, as each article passes between said singulation mechanism and said take-away mechanism;

said head separating and holding a doubled article, said negative pressure being cut off when a doubled article is detected as being said head.

* * * * *

UNITED STATES PATENT AND TRADEMARK OFFICE

CERTIFICATE OF CORRECTION

PATENT NO. : 6,270,069 B1
DATED : August 7, 2001
INVENTOR(S) : George Cera et al.

It is certified that error appears in the above-identified patent and that said Letters Patent is hereby corrected as shown below:

Title page,
Item [73], Assignee insert:
-- [73] Assignee: Lockheed Martin Corporation, Bethesda, Maryland --

Signed and Sealed this

Thirty-first Day of December, 2002

JAMES E. ROGAN
*Director of the United States Patent and Trademark Office*